US006001520A

United States Patent [19]

Nakamura et al.

[11] Patent Number: 6,001,520

[45] Date of Patent: Dec. 14, 1999

[54] ELECTROPHOTOGRAPHIC PHOTOSENSITIVE BODY AND METHOD OF MANUFACTURING SAME

[75] Inventors: Yoichi Nakamura; Motohiro Takeshima; Akira Ootani; Osamu Nabeta, all of Nagano, Japan

[73] Assignee: Fuji Electric Co., Ltd., Japan

[21] Appl. No.: 09/237,534

[22] Filed: Jan. 27, 1999

[30] Foreign Application Priority Data

Jan. 28, 1998 [JP] Japan ..... 10-015981

[51] Int. Cl.[6] ..... G03G 5/047

[52] U.S. Cl. ..... 430/58.05; 430/131; 430/132

[58] Field of Search ..... 430/58.05, 131, 430/132

[56] References Cited

U.S. PATENT DOCUMENTS 4,559,285 12/1985 Hoffmann ..... 430/58.05

5,045,421 9/1991 Fuse et al. ..... 430/58.05

5,534,978 7/1996 Nakamura et al. ..... 430/83

*Primary Examiner*—Roland Martin

*Attorney, Agent, or Firm*—Morrison Law Firm

[57] ABSTRACT

An electrophotographic photosensitive body has a charge generating layer and a charge transporting layer on a conductive substrate. The charge transporting layer contains a zinc carboxylate compound expressed by the following General Formula (I):

$$(Ar—COO^-)(R—COO^-)Zn^{2+} \quad [I]$$

wherein:

Ar is a substituted or unsubstituted aryl group and

R is a substituted or unsubstituted alkenyl group

A method for the manufacture of the electrophotographic photosensitive body is also disclosed.

14 Claims, 1 Drawing Sheet

ELECTROPHOTOGRAPHIC PHOTOSENSITIVE BODY AND METHOD OF MANUFACTURING SAME

BACKGROUND OF THE INVENTION

The present invention relates to an electrophotographic photosensitive body used for electrophotographic printers, copiers, and facsimile machines as well as to a manufacturing method for this photosensitive body. In particular, the present invention relates to an electrophotographic photosensitive body that is highly stable due to an improved additive for a charge-transporting layer, containing a charge-transporting material; and to a corresponding manufacturing method.

An electrophotographic photosensitive body must be capable of holding surface charges in a dark place and of generating or transporting these charges when exposed to light. Single-layer photosensitive bodies have all these functions in a single layer. Laminated photosensitive bodies are made up of a stack of laminated layers, each having separate functions. These laminated layers include a layer mainly contributing to the generation of charges and a layer mainly contributing to the retention of surface charges in a dark place and the transportation of charges on reception of light.

Image formation based on an electrophotographic process using such an electrophotographic photosensitive body uses, for example, the Carlson process. Image formation based on this process charges a photosensitive body in a dark place by means of corona discharge, forms an electrostatic latent image such as characters from a manuscript or a picture on the surface of the charged photosensitive body, develops the electrostatic latent image using toner, and transfers and fixes the developed toner image onto a support such as paper. After the toner image has been transferred, the photosensitive body is subjected to static charge erasing, residual-toner removal, and static recharge in preparation for reuse.

Conventional photosensitive materials for electrophotographic photosensitive bodies described above include either inorganic or organic photoconductive materials. The inorganic or organic photoconductive materials are diffused in a binder resin. The organic photoconductive material may be deposited by vacuum-evaporation or sublimation. Examples of inorganic photoconductive material include selenium, selenium alloys, zinc oxide, or cadmium sulfide. Examples of organic photoconductive materials include poly-N-vinylcarbazole; 9,10-anthracenediolepolyester; hydrazone; stilbene; butadiene; benzidine; phthalocyanine; or a bis azo compound.

It is also known that various additives are added as required to improve electrophotographic characteristics. For example, a salt composed of only a metal ion and an aromatic carboxylic acid is known as an additive for a charge transporting layer. This is described in, for example, Japanese Patent Application Laid Open No. 3-78753.

A zinc salt composed of only an aliphatic carboxylic acid is also known and described in, for example, Japanese Patent Application Laid Open No. 4-296867. Furthermore, the addition of a zinc salt composed of two or more types of aliphatic carboxylic acids is disclosed in Japanese Patent Application Laid Open No. 4-296867 despite an absence of descriptions of embodiments. As described above, various additives used to improve the electrophotographic characteristics of an electrophotographic photosensitive body have been examined, but their long-term stability, especially the stability of the residual potential during repeated use, has not been sufficiently improved. That is, the effect of an additive such as a zinc salt composed of an aromatic or aliphatic carboxylic acid in contributing to the stability of an electrophotographic photosensitive body and a coating liquid is insufficient, and its effects on stability have not been clarified.

OBJECTS AND SUMMARY OF THE INVENTION

It is an object of this invention to provide an electrophotographic photosensitive body with excellent stability which will overcome the foregoing problems.

It is a further object of the invention to provide a method of manufacturing an electrophotographic photosensitive body that exhibits excellent stability.

Briefly stated, the present invention provides an electrophotographic photosensitive body that has a charge generating layer and a charge transporting layer on a conductive substrate. The charge transporting layer contains a zinc carboxylate compound expressed by the following General Formula (I):

$$(AR—COO^-)(R—COO^-)Zn^{2+} \quad [I]$$

wherein:

Ar is a substituted or unsubstituted aryl group and

R is a substituted or unsubstituted alkenyl group

Additionally, a method for the manufacture of the electrophotographic photosensitive body is also disclosed.

According to an embodiment of the invention, there is provided an electrophotographic photosensitive body comprising: a charge generating layer and a charge transporting layer on a conductive substrate, said change transporting layer containing a zinc carboxylate compound expressed by the following General Formula (I):

$$(AR—COO^-)(R—COO^-)Zn^{2+} \quad [I]$$

wherein:

Ar is a substituted or unsubstituted aryl group and

R is a substituted or unsubstituted alkenyl group.

According to a feature of the invention, there is provided a method for manufacturing an electrophotographic photosensitive body comprising:

coating conductive substrate with a coating liquid containing a charge transporting material to form a charge transporting layer; and said coating liquid containing a zinc carboxylate compound as expressed by General Formula (I):

$$(AR—COO^-)(R—COO^-)Zn^{2+} \quad [I]$$

wherein:

Ar is a substituted or unsubstituted aryl group and

R is a substituted or unsubstituted alkenyl group.

The above, and other objects, features and advantages of the present invention will become apparent from the following description read in conjunction with the accompanying drawing, in which like reference numerals designate the same elements.

DETAILED DESCRIPTION OF THE INVENTION

Figure 1:
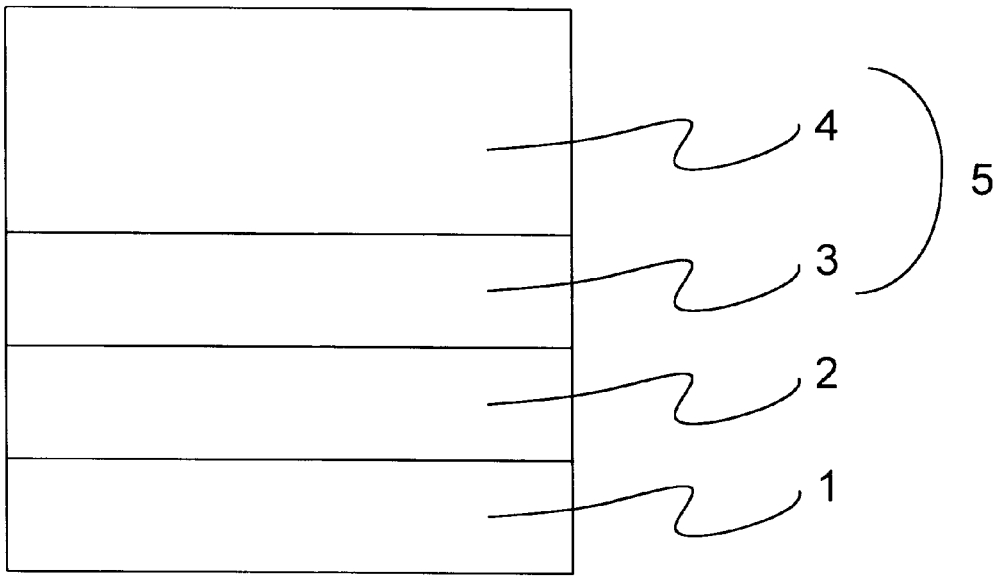
FIG. 1 is a schematic cross-sectional view of a negatively-charged electrophotographic photosensitive body.

The invention provides an electrophotographic photosensitive body comprising a charge generating layer and a charge transporting layer on a conductive substrate. The charge transporting layer contains a zinc carboxylate compound expressed by the following General Formula (I):

$$(AR—COO^-)(R—COO^-)Zn^{2+} \quad [I]$$

wherein:

Ar is a substituted or unsubstituted aryl group, and

R is a substituted or unsubstituted alkenyl group.

The inventors have also found that a coating liquid containing a charge transporting substance coats a conductive substrate quite easily if it contains a zinc carboxylate compound as expressed by General Formula (I). The inventors have created a process according to this invention. That is, the invention provides a process for making an electrophotographic photosensitive body, including the step of applying a coating liquid which contains a zinc carboxylate compound as expressed by General Formula (I) onto a conductive substrate to form a charge transporting layer.

The specific mechanism responsible for the containment of a zinc carboxylate compound as expressed by General Formula (I) to the charge-transporting layer and improving the stability of the electrophotographic photosensitive body is not fully understood. Although the inventors do not want to be limited to a particular theory, one possible explanation is given below.

Compared to the zinc salts described in Japanese Patent Application Laid Open Nos. 3-78753 and 4-296867, the zinc carboxylate compounds expressed by General Formula (I) are characterized by the non-localization of charges due to the resonant structure of each of the two different aryl groups and each of the two different carboxylic anions in the compound. Furthermore, by the use of two different carboxylic anions in the compound, a lower symmetry and a wider distribution of charges is achieved, thereby providing chemical stability of the carboxylate. This results in the long-term stability of the charge transporting layer containing the carboxylate. In the case of a zinc cinnamate salicylate, which is considered particularly favorable, this compound consists of a salicylic acid having the ortho-position of a phenyl group occupied by a hydroxyl group, and a cinnamic acid having the P location of a vinyl group occupied by a phenyl group. Therefore the hydroxyl, vinyl, and phenyl groups cause charges to be widely distributed, thereby improving stability.

Electrophotographic photosensitive bodies comprising a charge-generating layer and a charge-transporting layer on a conductive substrate include negatively-charged type and positively-charged type laminated photosensitive bodies. Although a specific negatively-charged type laminated photosensitive body is described below, any known structure, material or process may be selected for forming the photosensitive body that contains the zinc carboxylate compound expressed by General Formula (I).

Referring to FIG. 1, a function-separated negatively-charged electrophotographic photosensitive body includes an undercoat layer 2 coated on a conductive substrate 1. A photosensitive layer 5 is made up of a charge generating layer 3 coated onto the undercoat layer 2, and a charge transporting layer 4 coated onto the charge generating layer 3. As their names imply, the charge generating layer 3 has the principal function of charge generation, and the charge transporting layer 4 has the principal function of charge transport. The undercoat layer 2 is optional in some applications, and may be omitted. Charge transporting layer 4 contains a charge transporting material that transports charges generated in the charge generating layer on light exposure.

The conductive substrate 1 acts as both an electrode of the photosensitive body and as a support for the layers upon it. The conductive substrate 1 may be shaped as a cylinder, plate, or film. The conductive substrate may be made of a metal, such as aluminum, stainless steel, or nickel. Alternatively, the conductive substrate 1 may be made of a glass or a resin that is made conductive.

The undercoat layer 2 is an alcohol-soluble polyamide, a solvent-soluble aromatic polyamide, or a thermosetting-urethane resin. Preferable aromatic polyamides are those which are alcohol soluble, including copolymerized compounds of nylons 6, 8, 12, 66, 610, or 612, or N-alkyl modified nylon, and N-alkoxyalkyl modified nylon. Specific compounds include AMILAN CM 8,000 (manufactured by Toray Industries, Inc.; 6/66/610/12 copolymerized nylon), ELBAMIDE 9061 (manufactured by Du Pont Japan Ltd.; 6/66/612 copolymerized nylon), and DAIAMIDE T-170 (Daicel-Huels Co., Ltd.; copolymerized nylon mainly comprising nylon 12). Furthermore, inorganic fine powders such as $TiO_2$, alumina, calcium carbonate, or silica may be added to undercoat layer 2.

The charge generating layer 3 is formed by directly applying particles of a charge generating substance or by coating a mixture of a charge generating substance and a binder resin, both of which are dispersed in a solvent. The charge generating layer generates electric charges on receiving light. It is important for the charge generating layer 3 to have high charge generating efficiency and to inject generated charges into charge transporting layer 4. Ideally, charge injection does not depend significantly on electric fields and the charge generating layer 3 is capable of injecting charges at low electrical fields. Charge generating substances include pigments and dyes such as phthalocyanine, azo, quinone, indigo, cyanide, squalirium, and azulenium compounds.

Since only a charge generating function is required of the charge generating layer 4, the layer is made as thick as is necessary to obtain photosensitivity. The thickness of the layer is generally 5 $\mu$m or less, and preferably 1 $\mu$m or less.

The charge generating layer 3 comprises a charge generating substance with a charge transporting substance optionally added thereto. The binder resin for the charge generating layer may include an appropriate combination of a polymer or copolymer of polycarbonate, polyester, polyamide, polyurethane, epoxy, polyvinylbutylal, phenoxy, silicone, methacrylic ester, vinyl chloride, ketal, or vinyl acetate, or a halide or cyanoethylate thereof. From 10 to 5,000 parts by weight, preferably from 50 to 1,000 parts by weight of charge generating substance, is used per 100 parts by weight of a binder resin.

The charge transporting layer 4 is a coated film consisting of a material obtained by dissolving a charge transporting substance in the binder resin. For example, a hydrazone compound, a styryl compound, an amine compound, and their derivatives, or a combination thereof may be used as the charge transporting substance. This layer is capable of holding charges in a dark place as an insulating layer and of transporting charges injected from the charge generating layer on light reception. The binder resin for the charge transporting layer includes a polymer or copolymer of polycarbonate, polyester, polystyrene, or methacrylic ester. The binder resin must be compatible with the charge transporting substance as well as possess mechanical, chemical, and electric stability and adhesion. From 20 to 500 parts by weight, and preferably 30 to 300 parts by weight of charge transporting substance, is used for 100 parts by weight of binder resin. The film thickness of the charge transporting layer is preferably between 3 and 50 $\mu$m, and more preferably, between 15 and 40 $\mu$m, in order to maintain an effective surface potential.

According to the invention, the charge transporting layer containing the charge transporting substance is formed by applying a coating of liquid comprising a zinc carboxylate compound expressed by the following General Formula (I):

$$(AR—COO^-)(R—COO^-)Zn^{2+} \quad [I]$$

wherein:

Ar is a substituted or unsubstituted aryl group, and

R is a substituted or unsubstituted alkenyl group.

The term "aryl" is defined to include substituted or unsubstituted carbocyclic and heterocyclic aromatic ring systems.

An "alkenyl" group is a substituted or unsubstituted straight or branched carbon chain containing one of more double bonds.

A substituent for a "substituted aryl group" or a "substituted alkenyl group" is defined to include one or more chemically feasible substituents that would be well known to one skilled in the art. Such substituents include the following: straight, branched, or cyclic alkyl, alkenyl, or alkynyl groups; arylalkyl; arylalkenyl; arylalkynyl; carbonyl; —C(O)-alkyl; —C(O)-alkenyl; —C(O)-alkynyl; alkoxy; alkoxycarbonyl; alkoxyalkyl; alkoxyalkenyl; alkoxyalkynyl; hydroxy; thiol; amino; and amido; each of which may be further substituted.

In a preferred embodiment, Ar is a phenyl group and R is a lower alkenyl group. In another preferred embodiment, Ar is a phenyl group containing a hydroxy substituent and R is a lower alkenyl group optionally substituted with an aryl group. A particularly preferred zinc carboxylate compound is zinc salicylate cinnamate. This zinc carboxylate compound is expressed by the following formula:

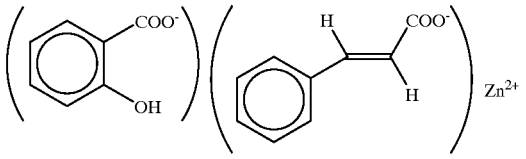

The zinc carboxylate compounds expressed by General Formula (I) can be obtained, for example, by mixing an aqueous solution of Ar—COONa and an aqueous solution of R—COONa, gradually adding an aqueous solution of zinc chloride, stirring and filtering the precipitate.

For the charge transporting layer containing the charge transporting substance, the amount of the zinc carboxylate compound used is 0.0001 to 1 parts by weight, preferably 0.001 to 0.1 parts by weight, for 10 parts by weight of binder resin.

In addition, the coating liquid for the charge transporting layer according to the manufacturing process of this invention is applicable to various coating processes, such as dip coating processes and spray coating processes, and is not limited to a particular coating process.

EXAMPLE 1

Example of the Manufacture of a Zinc Cinnamate Salicylate

About 160.1 parts by weight of sodium salicylate (manufactured by Wako Pure Chemical Industries, Ltd.) was dissolved into 173 parts by weight of water to obtain an aqueous solution of sodium salicylate. Next, 170.1 parts by weight of sodium cinnamate (manufactured by Wako Pure Chemical Industries, Ltd.) was dissolved into 4253 parts by weight of water to obtain an aqueous solution of sodium cinnamate. Then, 136.3 parts by weight of zinc chloride (manufactured by Wako Pure Chemical Industries, Ltd.) was dissolved into 39 parts by weight of water to obtain a solution of zinc chloride in water.

To the aqueous solution of sodium salicylate and the aqueous solution of sodium cinnamate was gradually added the aqueous solution of zinc chloride. The resulting mixture was stirred and the precipitate was filtered, washed with water, and dried to obtain a zinc cinnamate salicylate.

The other zinc carboxylate compounds expressed by General Formula (I) used in the following embodiments were synthesized using their corresponding carboxylic acids.

Embodiment 1

About 70 parts by weight of polyamide resin (AMILAN CM8000 manufactured by Toray Industries, Inc.) and 930 parts by weight of methanol (manufactured by Wako Pure Chemical Industries, Ltd.) were mixed together to produce a coating liquid for the undercoat layer. The coating liquid was applied to an aluminum substrate using a dip coating process and dried to form an undercoat layer 0.5 μm thick.

Ten parts by weight of bis azo compound (manufactured by Fuji Electric Co., Ltd.) expressed by the following formula,

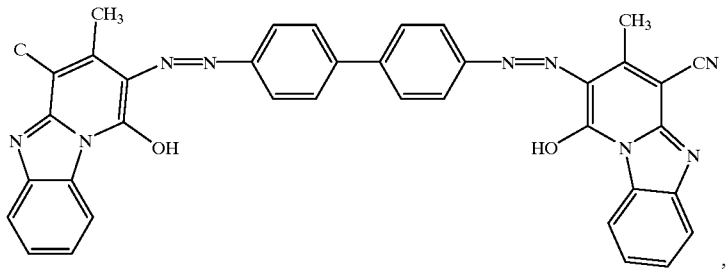

882 parts by weight of 2-butanone (manufactured by Wako Pure Chemical Industries Ltd.), 98 parts by weight of cyclohexane (manufactured by Wako Pure Chemical Industries, Ltd.), and 10 parts by weight of polyvinylacetal resin (S-LEC KS-1 manufactured by Sekisui Chemical Co., Ltd.) were mixed and ultrasonically dispersed to produce a coating liquid for the charge generating layer. This coating liquid was applied to the undercoat layer using a dip coating process and dried to form a charge generating layer 0.2 μm thick.

One hundred parts by weight of 4-(diphenylamino) benzaldehyde phenyl (2-thienylmethyl) hydrazone (manufactured by Fuji Electric Co., Ltd.), 100 parts by weight of polycarbonate resin (PANLITE K-1300 manufactured by Teijin Chemicals Ltd.), 800 parts by weight of dichloromethane, and 1 part by weight of silane coupling agent (KP-340 manufactured by Shin-Etsu Chemical Industry Co., Ltd.) were mixed with 0.01 parts by weight of a zinc cinnamate salicylate (manufactured by Fuji Electric Co. Ltd.), made as above, to produce a coating liquid for the charge transporting layer. This coating liquid was applied to the charge generating layer, using a dip coating process, and dried to form a charge generating layer 20 μm thick, to produce an electrophotographic photosensitive body.

Embodiment 2

An electrophotographic photosensitive body was made by producing a coating liquid for the charge transporting layer as in Embodiment 1, except that the zinc cinnamate salicylate was replaced with the zinc carboxylate compound (manufactured by Fuji Electric Co., Ltd.) compound expressed by the following formula:

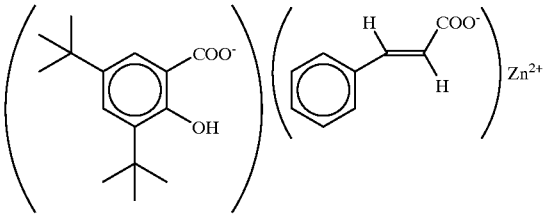

Embodiment 3

An electrophotographic photosensitive body was made by producing a coating liquid for the charge transporting layer as in Embodiment 1, except that the zinc cinnamate salicylate was replaced with the zinc carboxylate compound (manufactured by Fuji Electric Co., Ltd.) expressed by the following formula:

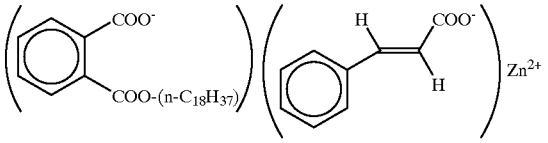

Embodiment 4

An electrophotographic photosensitive body was made by producing a coating liquid for the charge transporting layer as in Embodiment 1, except that the zinc cinnamate salicylate was replaced with the zinc carboxylate compound (manufactured by Fuji Electric Co., Ltd.) expressed by the following formula:

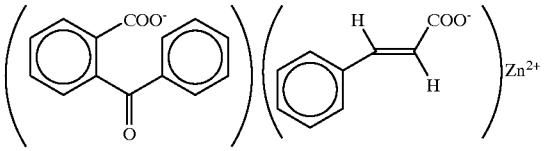

Comparative Example 1

An electrophotographic photosensitive body was made by producing a coating liquid for the charge transporting layer as in Embodiment 1, except that the zinc cinnamate salicylate was replaced with the zinc carboxylate compound (manufactured by Fuji Electric Co., Ltd.) expressed by the following formula:

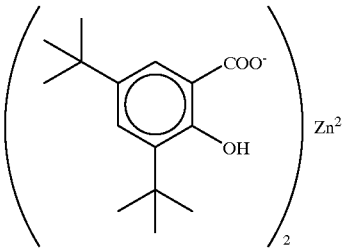

Comparative Example 2

An electrophotographic photosensitive body was made by producing a coating liquid for the charge transporting layer as in Embodiment 1, except that the zinc cinnamate salicylate was replaced with the zinc carboxylate compound (manufactured by Fuji Electric Co., Ltd.) expressed by the following formula:

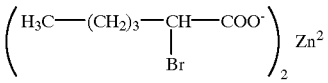

The electric characteristics of the electrophotographic photosensitive bodies obtained according to Embodiments 1 to 4 and Comparative Examples 1 and 2 in the above manner were measured using an electrostatic recording paper test apparatus (EPA-8200 manufactured by Kawaguchi Electric Works Co., Ltd.). Corona discharge at −5 kV was provided in a dark place for 10 seconds to apply a negative charge to the surface of the electrophotographic photosensitive body. The surface was subsequently irradiated with white light at 5 lux-s, and the residual potential was then measured. The residual potential value was referred to as an initial residual potential.

A similar cycle of static elimination, charging, and exposure was repeated 100,000 times and the residual potential was then measured. This value was referred to as a residual potential after repetition.

Table 1 shows the results obtained.

TABLE 1

| | Initial residual potential (V) | Residual potential after repetition (V) |
|---|---|---|
| Embodiment 1 | −8 | −23 |
| Embodiment 2 | −5 | −20 |
| Embodiment 3 | −12 | −29 |
| Embodiment 4 | −10 | −27 |
| Comparative Ex. 1 | −6 | −46 |
| Comparative Ex. 2 | −10 | −68 |

As is apparent from Table 1, each of Embodiments 1 through 4 had a low and stable residual potential after repetition, whereas comparative examples had large absolute values for residual potential after repetition.

Having described preferred embodiments of the invention with reference to the accompanying drawing, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photosensitive body comprising:

a charge generating layer and a charge transporting layer on a conductive substrate, said change transporting layer containing a zinc carboxylate compound expressed by the following General Formula (I):

$$(AR—COO^-)(R—COO^-)Zn^{2+} \quad [I]$$

wherein:

Ar is a substituted or unsubstituted aryl group; and

R is a substituted or unsubstituted alkenyl group.

2. The electrophotographic photosensitive body of claim 1, wherein said aryl group is one of a substituted and a unsubstituted phenyl group.

3. The electrophotographic photosensitive body of claim 2, wherein said aryl group is substituted with a hydroxyl group.

4. The electrophotographic photosensitive body of claim 3, wherein said hydroxyl group is at the ortho position of the phenyl group.

5. The electrophotographic photosensitive body of claim 1, wherein R is one of a $C_2$–$C_6$ substituted and a $C_2$–$C_6$ unsubstituted alkenyl group.

6. The electrophotographic photosensitive body of claim 1, wherein R is one of a substituted or an unsubstituted vinyl group.

7. The electrophotographic photosensitive body of claim 1, wherein said zinc carboxylate compound is a zinc cinnamate salicylate.

8. A method for making an electrophotographic photosensitive body comprising:

coating a conductive substrate with a liquid containing a charge generating material to form a charge generating layer;

coating a conductive substrate with a coating liquid containing a charge transporting material to form a charge transporting layer;

said coating liquid containing a zinc carboxylate compound as expressed by General Formula (I):

$$(Ar—COO^-)(R—COO^-)Zn^{2+} \quad [I]$$

wherein:

Ar is a substituted or unsubstituted aryl group; and

R is a substituted or unsubstituted alkenyl group.

9. A method for making an electrophotographic photosensitive body of claim 8, wherein said aryl group is one of a substituted and a unsubstituted phenyl group.

10. A method for making an electrophotographic photosensitive body of claim 9, wherein said aryl group is substituted with a hydroxyl group.

11. A method for making an electrophotographic photosensitive body of claim 10, wherein said hydroxyl group is at the ortho position of the phenyl group.

12. A method for making the electrophotographic photosensitive body of claim 8, wherein R is one of a $C_2$–$C_6$ substituted and a $C_2$–$C_6$ unsubstituted alkenyl group.

13. A method for making the electrophotographic photosensitive body of claim 8, wherein R is one of a substituted or an unsubstituted vinyl group.

14. A method for making the electrophotographic photosensitive body of claim 8, wherein said zinc carboxylate compound is a zinc cinnamate salicylate.

* * * * *